US009096339B2

(12) United States Patent
Koike

(10) Patent No.: US 9,096,339 B2
(45) Date of Patent: Aug. 4, 2015

(54) METHOD OF PRODUCING ADHESIVE LABELS AND PRINTER

(75) Inventor: Yoshimitsu Koike, Suwa (JP)

(73) Assignee: SEIKO EPSON CORPORATION, Tokyo (JP)

( * ) Notice: Subject to any disclaimer, the term of this patent is extended or adjusted under 35 U.S.C. 154(b) by 484 days.

(21) Appl. No.: 13/103,387

(22) Filed: May 9, 2011

(65) Prior Publication Data

US 2011/0277905 A1 Nov. 17, 2011

(30) Foreign Application Priority Data

May 13, 2010 (JP) ..... 2010-110882

(51) Int. Cl.

| | |
|---|---|
| ***B65C 9/18*** | (2006.01) |
| ***B65C 9/20*** | (2006.01) |
| ***B41J 3/407*** | (2006.01) |
| ***B41J 11/70*** | (2006.01) |

(52) U.S. Cl.

CPC ..... *B65C 9/20* (2013.01); *B41J 3/4075* (2013.01); *B41J 11/703* (2013.01)

(58) Field of Classification Search

CPC ..... B65C 9/1803; B65C 11/0284; B65C 2009/1857; B65C 2009/1861; B65C 2210/0037; B65C 9/20; B41J 11/703; B41J 3/4075

USPC ..... 156/351, 353, 358, 384, 387, 581

See application file for complete search history.

(56) References Cited

U.S. PATENT DOCUMENTS

| | | | | |
|---|---|---|---|---|
| 4,108,710 | A * | 8/1978 | Hoffmann | 156/450 |
| 6,270,612 | B1 * | 8/2001 | Bradshaw | 156/234 |
| 6,857,714 | B2 * | 2/2005 | Hohberger et al. | 347/2 |
| 2002/0168212 | A1 * | 11/2002 | Nedblake et al. | 400/621 |

FOREIGN PATENT DOCUMENTS

| | | | |
|---|---|---|---|
| JP | 4514498 | B | 5/1970 |
| JP | 56141114 | U | 3/1980 |
| JP | 554225 | U | 7/1993 |
| JP | 2003-089247 | A | 3/2003 |
| JP | 2004-035043 | A | 2/2004 |
| JP | 2006151518 | A | 6/2006 |

* cited by examiner

*Primary Examiner* — George Koch

(74) *Attorney, Agent, or Firm* — Lowe Hauptman & Ham, LLP

(57) ABSTRACT

A printer has a printer unit including a recording head and automatic cutter, and an adhesive transfer unit disposed downstream from the automatic cutter. The adhesive transfer unit has a transfer mechanism that supplies adhesive tape and transfers adhesive to recording paper at a transfer position. When a paper detector disposed upstream from the transfer position detects recording paper, the control unit of the printer causes the pressure mechanism to alternately form the contact state pressing the recording paper to the adhesive tape, and the non-contact state in which the recording paper is separated from the adhesive tape. Adhesive is transferred to the recording paper passing the transfer position while this contact operation repeats intermittently.

12 Claims, 4 Drawing Sheets

METHOD OF PRODUCING ADHESIVE LABELS AND PRINTER

RELATED APPLICATIONS

The present application is based on, and claims priority from, Japanese Application Number 2010-110882, filed May 13, 2010, the disclosure of which is hereby incorporated by reference herein in its entirety.

BACKGROUND

1. Technical Field

The present invention relates to a method of producing adhesive labels and to a device for producing adhesive labels, and relates more particularly to a method of producing adhesive labels that forms an adhesive portion on the recording paper after printing, and to a printer.

2. Related Art

Label paper that has labels with an adhesive surface affixed to a web liner is typically used to produce adhesive labels. Because the web liner portion of such label paper becomes waste once the labels are removed, linerless label paper that omits the web liner is also used. Japanese Unexamined Patent Appl. Pub. JP-A-2003-089247, for example, teaches a printer that prints on the printing surface of linerless label paper, the back side of which is coated with adhesive, and cuts off the printed portion to produce a label.

One type of linerless label paper is coated on the reverse side with a heat sensitive adhesive layer that is activated by heat. Japanese Unexamined Patent Appl. Pub. JP-A-2004-035043 teaches a printer that prints on heat-activated adhesive label paper (also called "delayed tack" paper), and can activate the adhesive by heating the label paper with a heater after cutting the label paper with an automatic paper cutter.

Because the adhesive surface of the label paper used in JP-A-2003-089247 is exposed, the printing surface is coated with a release agent when the label paper is wound into a roll for easy loading into the printer so that the labels can be easily peeled. As a result, when the label paper pulled from the roll is set and conveyed through the paper path inside the printer while printing, the release agent can separate from the printing surface and collect on the printhead, possibly resulting in printing problems. Adhesion of the adhesive on the printhead, paper path, paper cutter, or other parts can also lead to paper jams. To prevent such problems, the printhead, paper path, paper cutter, and other parts must be given an anti-stick surface treatment or an adhesive removal mechanism must be provided. Alternatively, regular maintenance is required to remove any accumulated adhesive or release agent buildup. As a result, device cost increases or the cost of maintenance increases.

When heat-activated adhesive label paper is used and the adhesive is activated after cutting a label as described in JP-A-2004-035043, a relatively large heating mechanism and power supply must be provided to heat and activate the adhesive inside the printer. This increases device size and cost.

Linerless label paper such as described in JP-A-2003-089247 and JP-A-2004-035043 eliminates the backing liner but is still more expensive than plain paper because it is precoated with adhesive. In addition, because the adhesive layer is formed over the entire reverse side of the label paper, adhesive is wasted when adhesive is only needed on part of the label. The cost of producing the adhesive labels is therefore higher than necessary.

SUMMARY

With consideration for these problems, the present invention provides technology that can reduce the occurrence of paper jams and printing problems inside a printer when producing adhesive labels, and can produce adhesive labels at a low cost with low maintenance requirements without requiring a cumbersome heating device or adhesive removal mechanism disposed to the printer.

A first aspect of the invention is a printer including: a transportation mechanism that conveys a recording medium web through a transportation path passed a printing position; a recording head that prints on the front side of the recording medium at the printing position; an automatic cutter that cuts the recording medium at a cutting position downstream from the printing position on the transportation path; and an adhesive application mechanism that applies adhesive to the reverse side of the recording medium passing downstream from the cutting position on the transportation path.

A printer according to the invention applies adhesive to the recording medium after the recording medium passes the automatic cutting position of the automatic cutter, and can thereby produce adhesive labels using inexpensive plain paper instead of needing to use expensive recording media that is precoated with adhesive. With this aspect of the invention, adhesive or release agent will also not stick to or build up on the recording head, automatic cutter, or the transportation path upstream from the transfer position. Applying an anti-stickiness surface treatment to these parts is therefore not necessary in order to prevent paper jams and printing problems caused by adhesive or release agent. There is also no need to provide a mechanism for adhesive removal, and no need for regular maintenance to remove adhesive. There is also no need for a bulky heating mechanism or power supply such as needed for heating and activating a heat-activated adhesive coating previously applied to the recording medium. Printer cost and size can therefore be reduced, and maintenance requirements can be reduced.

In another aspect of the invention, the adhesive application mechanism is a transfer mechanism that transfers adhesive that is coated on a release film to the reverse side of the recording medium passing a transfer position that is located downstream from the cutting position on the transportation path. A uniform adhesive layer can be formed with this method.

The transfer mechanism preferably includes a transfer roller that is disposed freely rotatably with the roller surface thereof facing the recording medium passing the transfer position, and has the release film web wound around the roller surface with the adhesive coating surface to the outside; a supply unit that supplies the release film to the transfer roller; a take-up unit that rewinds the release film after passing the transfer roller; and a pressure mechanism that produces a contact state in which the recording medium is pressed against the adhesive coating surface, or a non-contact state in which the recording medium is not pressed against the adhesive coating surface, by moving a pressure member opposing the roller surface of the transfer roller to and away from the roller surface.

Adhesive can thus be easily supplied by supplying a web of release film that is coated with adhesive to the transfer position and then rewinding the release film after it is used. In addition, the position and area to which the adhesive is transferred can be controlled by controlling the drive timing of the pressure mechanism.

A printer according to another aspect of the invention preferably also has a recording medium detection sensor disposed upstream from the transfer position on the transportation path; and a control unit that switches the pressure mechanism between the contact state and the non-contact state based on output from the detection sensor.

This aspect of the invention enables desirably controlling the position and area to which the adhesive is transferred because the conveyance position of the recording medium is known from the sensor output.

Further preferably, the control unit alternately switches the pressure mechanism between the contact state and the non-contact state at a specified interval. This enables transferring adhesive to the recording medium at a specific interval. Adhesive can therefore be used efficiently and adhesive strength can be adjusted.

A printer according to another aspect of the invention preferably also has a first transportation roller that conveys the recording medium at a first transportation position upstream from the cutting position on the transportation path; a second transportation roller that conveys the recording medium at the transfer position; and a transfer mechanism that causes the second transportation roller to rotate in conjunction with rotation of the first transportation roller.

By conveying the recording medium at the transfer position, this aspect of the invention can reliably apply adhesive to the recording medium and discharge the recording medium from the printer. In addition, because the cut-off portion of the recording medium is conveyed by the second transportation roller, the cut-off portion of the recording medium can be reliably coated with adhesive and discharged from the printer. In addition, printer construction can be simplified because the paper feed drive source is used with the first transportation roller.

Further preferably, the second transportation roller is disposed coaxially with the transfer roller, and the transfer roller and second transportation roller rotate in unison. This aspect of the invention prevents adhesive transfer errors because the recording medium transportation operation and the transfer operation of the transfer roller can be synchronized.

Further preferably, the printer according to another aspect of the invention also has a clutch means that can switch between an engaged position causing the second transportation roller to rotate in conjunction with the first transportation roller, and a disengaged position that does not cause the second transportation roller to rotate in conjunction with the first transportation roller.

This configuration enables allowing the second transportation roller to rotate freely when the first transportation roller is stopped, and thus enables pulling the cut portion of the recording medium out by hand. In addition, by disengaging the clutch when the first transportation roller reverses the recording medium, reversing the portion of recording medium coated with adhesive and reversing the release film can be prevented. In addition, by disengaging the clutch when not transferring adhesive, wastefully rewinding unused release film can be prevented because the second transportation roller and transfer roller rotate freely.

In aspect of the invention, the second transportation roller is attached to both ends of the rotating shaft of the transfer roller with the transfer roller therebetween, and is disposed within the width of the recording medium at the transfer position.

Because both edges of the width of the recording medium contact a transportation roller, the recording medium is conveyed evenly on both sides, thereby preventing skewing and other paper feed problems. Adhesive can also be applied to the middle of the width of the recording medium.

In another aspect of the invention, the adhesive application mechanism is rendered as an adhesive application unit that is removably attached to the printer downstream from the cutting position.

Because the adhesive application mechanism can be installed and detached as needed, this aspect of the invention enables converting a receipt printer to a printer for printing adhesive labels, and converting the other way. Printer utility is thus improved for the user. Device cost can also be reduced by sharing components.

Another aspect of the invention is a method of producing adhesive labels, including steps of: conveying a recording medium web through a transportation path inside a printer; printing on the front side of the recording medium while conveying the recording medium; automatically cutting the printed portion of the recording medium downstream from the printing position; and applying adhesive to the reverse side of the recording medium while the recording medium travels downstream from the recording medium cutting position on the transportation path before or after automatically cutting the recording medium.

A method of producing adhesive labels according to another aspect of the invention includes steps of: conveying a recording medium web through a transportation path inside a printer; printing on the front side of the recording medium while conveying the recording medium; automatically cutting the printed portion of the recording medium downstream from the printing position; producing a contact state pressing the reverse side of the recording medium against the adhesive coating surface of a release film mounted on a transfer roller downstream from the cutting position of the recording medium on the transportation path before or after automatic cutting; and transferring adhesive from the release film to the reverse side of the recording medium as the recording medium passes the transfer position while the contact state is held by performing an operation that automatically conveys the recording medium before cutting by means of a paper feed mechanism of the printer, or an operation that manually pulls the cut recording medium downstream.

This method preferably also detects if recording medium is present upstream from the transfer position; and produces the contact state or non-contact state based on whether or not the recording medium is detected. Further preferably, the contact state and the non-contact state, which is the state in which the adhesive coating surface is not pressed to the reverse side of the recording medium, are alternately produced at the transfer position at a specific time interval while the recording medium is detected.

The invention can also use plain paper as the recording medium.

The invention thus enables producing adhesive labels using inexpensive plain paper instead of using expensive recording media that is precoated with adhesive. Adhesive labels can thus be produced at a lower cost than before. In addition, by printing and cutting the recording medium without operating an adhesive application mechanism such as the transfer mechanism, receipts and other printout can be issued without forming an adhesive part. Furthermore, because adhesive labels and receipts can be printed using the same recording medium, adhesive labels and receipts can be produced without changing the recording medium. User convenience is thus extremely good.

EFFECT OF THE INVENTION

The invention applies adhesive to the recording medium after the recording medium passes the automatic cutting position of the automatic cutter, and can thereby produce adhesive labels using inexpensive plain paper instead of needing to use expensive recording media that is precoated with adhesive. With this aspect of the invention, adhesive or release agent will also not stick to or build up on the recording head, automatic cutter, or the transportation path upstream from the transfer position. Applying an anti-stickiness surface treatment to these parts is therefore not necessary in order to prevent paper jams and printing problems caused by adhesive or release agent. There is also no need to provide a mechanism for adhesive removal, and no need for regular maintenance to remove adhesive. There is also no need for a bulky heating mechanism or power supply such as needed for heating and activating a heat-activated adhesive coating previously applied to the recording medium. Printer cost and size can therefore be reduced, and maintenance requirements can be reduced.

Other objects and attainments together with a fuller understanding of the invention will become apparent and appreciated by referring to the following description and claims taken in conjunction with the accompanying drawings.

DESCRIPTION OF EMBODIMENTS

A preferred embodiment of a printer and a method of producing adhesive labels according to the present invention is described below with reference to the accompanying figures.

Figure 1:
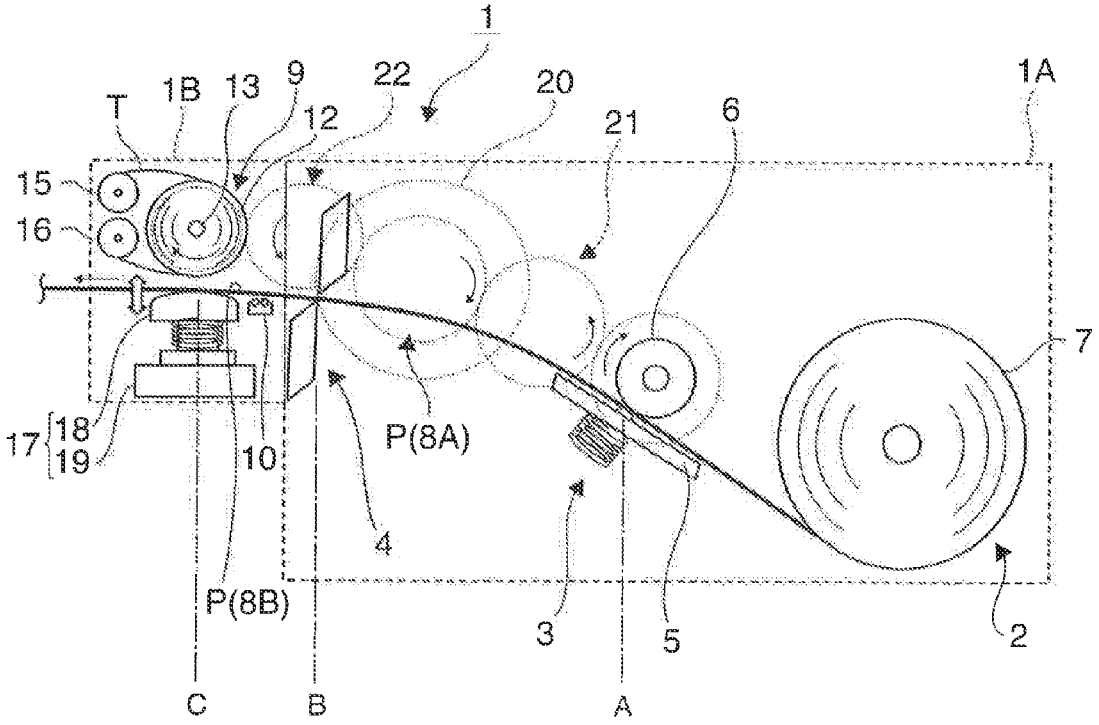
FIG. 1 is a section view showing the main parts of a printer according to a preferred embodiment of the invention.
Figure 2:
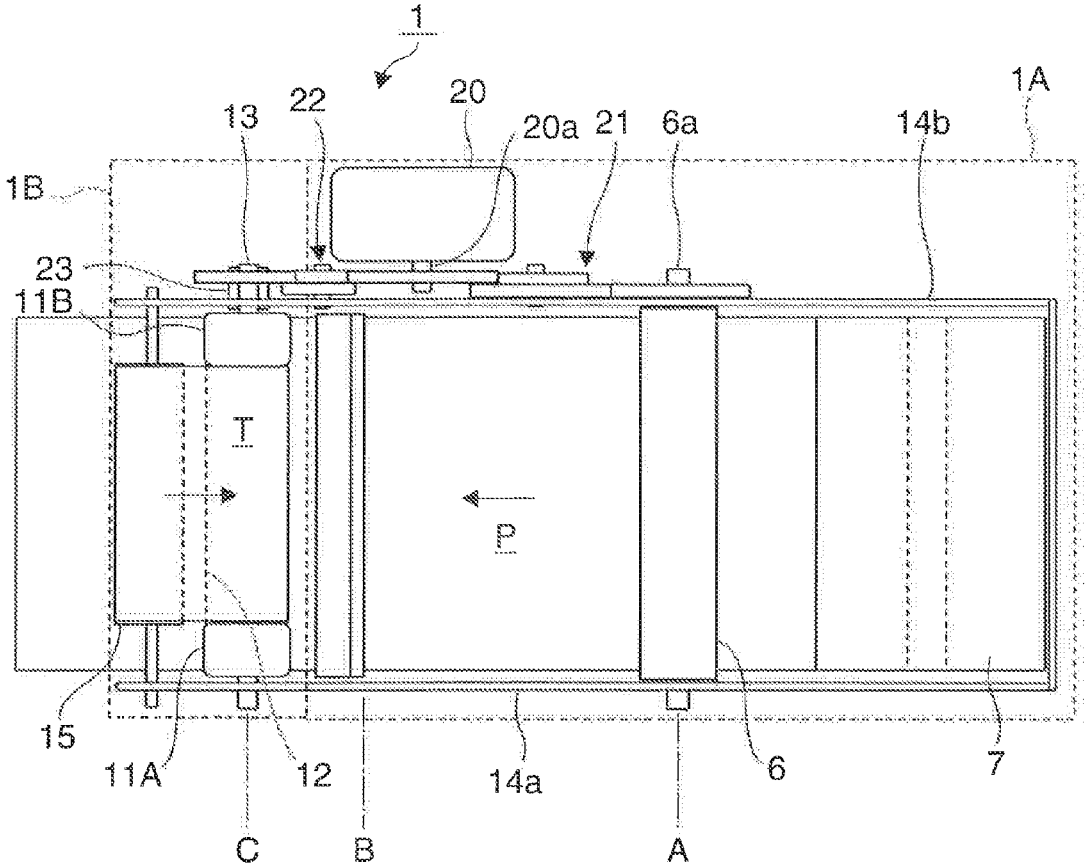
FIG. 2 is a plan view showing the main parts of a printer according to a preferred embodiment of the invention.

FIG. 1 is a section view showing main parts of the printer, and FIG. 2 is a plan view showing main parts of the printer. As shown in FIG. 1 and FIG. 2, the printer 1 has a printer unit 1A including a roll paper compartment 2, print mechanism 3, and automatic cutter 4, and an adhesive transfer unit 1B that is disposed to the front of the printer unit 1A.

The print mechanism 3 includes a recording head 5 and a platen roller 6 (first transportation roller) disposed opposite the recording head 5. A thermal head is used as the recording head 5 in this embodiment of the invention. The recording paper P that is pulled from the paper roll 7 loaded in the roll paper compartment 2 is threaded passed the printing position A (first transportation position) by the recording head 5 and platen roller 6, and the recording paper P is conveyed from the paper roll 7 toward the printing position A as the platen roller 6 turns. The print mechanism 3 prints on the surface of the recording paper P by driving the recording head 5 in conjunction with this paper feed operation.

The printed portion of the recording paper P is then guided by a paper guide member not shown to the cutting position B of the automatic cutter 4, and is conveyed passed the cutting position B. This embodiment of the invention uses plain paper such as used for printing receipts as the recording paper P, but a recording medium other than plain paper can be used instead.

The automatic cutter 4 is disposed where the adhesive transfer unit 1B is connected to the printer unit 1A. After being conveyed through the paper feed path 8A that passes the printing position A and cutting position B inside the printer unit 1A, the recording paper P is guided into the adhesive transfer unit 1B. The recording paper P is then conveyed through a paper feed path 8B inside the adhesive transfer unit 1B that is contiguous to the paper feed path 8A, and is discharged to the outside of the printer 1.

Disposed to the adhesive transfer unit 1B are an adhesive transfer mechanism 9 (adhesive application mechanism) and a paper detector 10. The transfer mechanism 9 transfer adhesive to the recording paper P conveyed through the paper feed path 8B. The paper detector 10 detects if recording paper P is present upstream from the transfer position C of the transfer mechanism 9.

Feed rollers 11A and 11B that can convey the recording paper P in conjunction with rotation of the platen roller 6, which is the recording paper transportation mechanism on the printer unit 1A side, are also disposed to the adhesive transfer unit 1B.

The transfer mechanism 9 has a transfer roller 12 disposed on the back side (the top side as seen in FIG. 1) of the recording paper P at the transfer position C. This transfer roller 12 is attached to an axle 13 extending transversely to the recording paper P. The ends of the axle 13 are supported freely rotatably by the left and right side frames 14*a*, 14*b* of the printer 1. The feed rollers 11A and 11B are disposed on opposite ends of the axle 13 with the transfer roller 12 therebetween, and attached to rotate in unison with the axle 13. The transfer roller 12 is disposed in the center of width of the recording paper P, and the rolling surfaces of the feed rollers 11A and 11B (second transportation rollers) contact the left and right edge parts of the recording paper P.

The transfer mechanism 9 also has a supply drum 15 (supply unit) and a take-up drum 16 (take-up unit) disposed to rotate freely on a rotational axis parallel to the transfer roller 12.

Unused adhesive tape T that is wound into a roll is mounted on the supply drum 15. The adhesive tape T has adhesive coating on one side of a web of release film, and the adhesive can be transferred to the recording paper P by pressing the adhesive-coated side against the recording paper P. When the adhesive tape T is threaded from the supply drum 15 around the transfer roller 12 with the adhesive side to the outside and then taken up onto the take-up drum 16, the adhesive side of the adhesive tape T is disposed opposite the reverse side of the recording paper P as it passes the transfer position C.

When unused adhesive tape T is fed from the supply drum 15 to the transfer roller 12 side, the used portion of the adhesive tape T is rewound by the take-up drum 16, which rotates in conjunction with the supply drum 15, after passing the transfer roller 12. The mechanism (not shown in the figure) for synchronously driving the supply drum 15 and take-up drum 16 is configured to synchronously drive while shifting the rotational positions of the supply drum 15 and take-up drum 16 as the diameter of the roll on the supply side decreases and the diameter of the roll on the take-up side increases. As a result, appropriate tension can be kept on the adhesive tape T. The configuration for supplying adhesive tape T to the transfer position C and rewinding the used adhesive tape T is obviously not limited to the foregoing, and can be modified as needed.

The transfer mechanism 9 also has a pressure mechanism 17 for applying pressure to the roller surface of the transfer roller 12. This pressure mechanism 17 includes a pressure platen 18 (pressure member) disposed opposite the roller surface of the transfer roller 12, and a reciprocating plunger 19 that can push the pressure platen 18 to the roller surface and retract the pressure platen 18 from the roller surface.

When the plunger 19 is driven and pushes the pressure platen 18 to the transfer roller 12 side in the contact position (state), the reverse side of the recording paper P is pressed against the adhesive coating side of the adhesive tape T wound around the transfer roller 12. When the pressure platen 18 moves away from the transfer roller 12 to the non-contact position (state), the recording paper P is no longer in contact with the adhesive tape T.

As the feed rollers 11A and 11B rotate and convey the recording paper P, the transfer roller 12 rotates in unison and the adhesive tape T advances with the recording paper P. Therefore if the recording paper P is conveyed in the contact state, the recording paper P and adhesive tape T pass in contact with each between the pressure platen 18 and transfer roller 12. Adhesive is transferred from the adhesive tape T to the recording paper P at this time. When in the non-contact state, the recording paper P simply passes the transfer position C, adhesive is not transferred thereto, and the transfer roller 12 rotates freely according to the paper feed distance.

The rotating axle 6*a* of the platen roller 6 extends freely rotatably between the left and right side frames 14*a*, 14*b* of the printer 1. A paper feed motor 20 is disposed on the outside of one side frame 14*b*. A transfer wheel train 21 (transmission mechanism) is disposed between the output shaft 20*a* of the paper feed motor 20 and the axle 6*a* protruding to the paper feed motor 20 side, and transfers rotation of the output shaft 20*a* to the axle 6*a* at a specific speed reducing ratio.

One end of the axle 13 of the feed rollers 11A and 11B also protrudes to the outside of the side frame 14*b* similarly to the axle 6*a*. A transfer wheel train 22 (transmission mechanism) that transfers rotation of the output shaft 20*a* to the axle 13 at a specific speed reducing ratio is disposed between the axle 13 and the output shaft 20*a*, and an electromagnetic clutch 23 (clutch means) is disposed between the output gear of the transfer wheel train 22 and the axle 13.

When the electromagnetic clutch 23 disengages, rotation of the output gear of the transfer wheel train 22 is not transferred to the axle 13. As a result, only the platen roller 6 rotates and the feed rollers 11A and 11B do not rotate when the paper feed motor 20 is driven.

When the electromagnetic clutch 23 is engaged, rotation of the output gear of the transfer wheel train 22 is transferred to the axle 13. As a result, when the paper feed motor 20 is driven, the platen roller 6 and feed rollers 11A and 11B rotate in unison, and the recording paper P is conveyed at two positions, the printing position A and the transfer position C.

Figure 3:
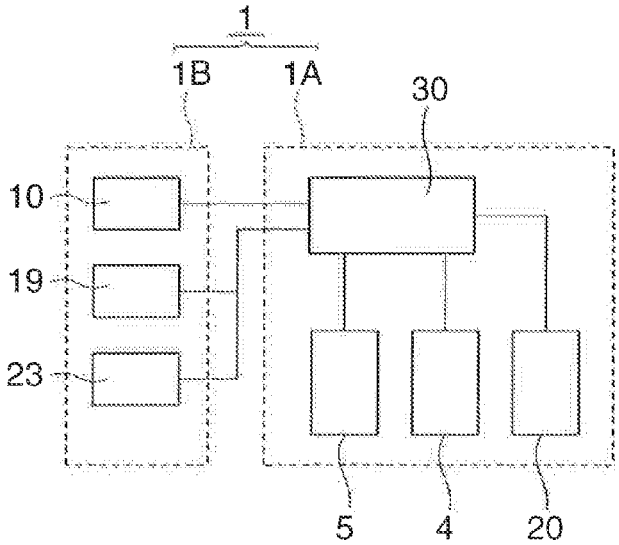
FIG. 3 is a block diagram schematically describing the control system of the printer.

FIG. 3 is a block diagram showing the configuration of the printer control system. The control system of the printer 1 is built around a control unit 30 that includes a CPU and storage such as ROM or RAM. The control unit 30 is connected to a host device not shown, and control parts of the printer 1 based on print data and commands received from the host device. Detection signals from the paper detector 10 are also input to the control unit 30, which determines the paper feed position of the recording paper P and controls other parts of the printer 1 based on the detection signal from the paper detector 10.

The control unit 30 drives the paper feed motor 20 and recording head 5 and prints on recording paper P based on the received print data. The control unit 30 also drives the automatic cutter 4 and cuts the recording paper P timed to the cutting position of the recording paper P passing the cutting position B. The control unit 30 also drives the plunger 19 of the pressure mechanism 17 to render the contact state timed to the part of the recording paper P to which adhesive is to be transferred passing the transfer position C. By controlling the on/off state of the electromagnetic clutch 23, the control unit 30 appropriately conveys the recording paper P through the printer unit 1A and the adhesive transfer unit 1B.

Controlling Adhesive Label Production

Figure 4:
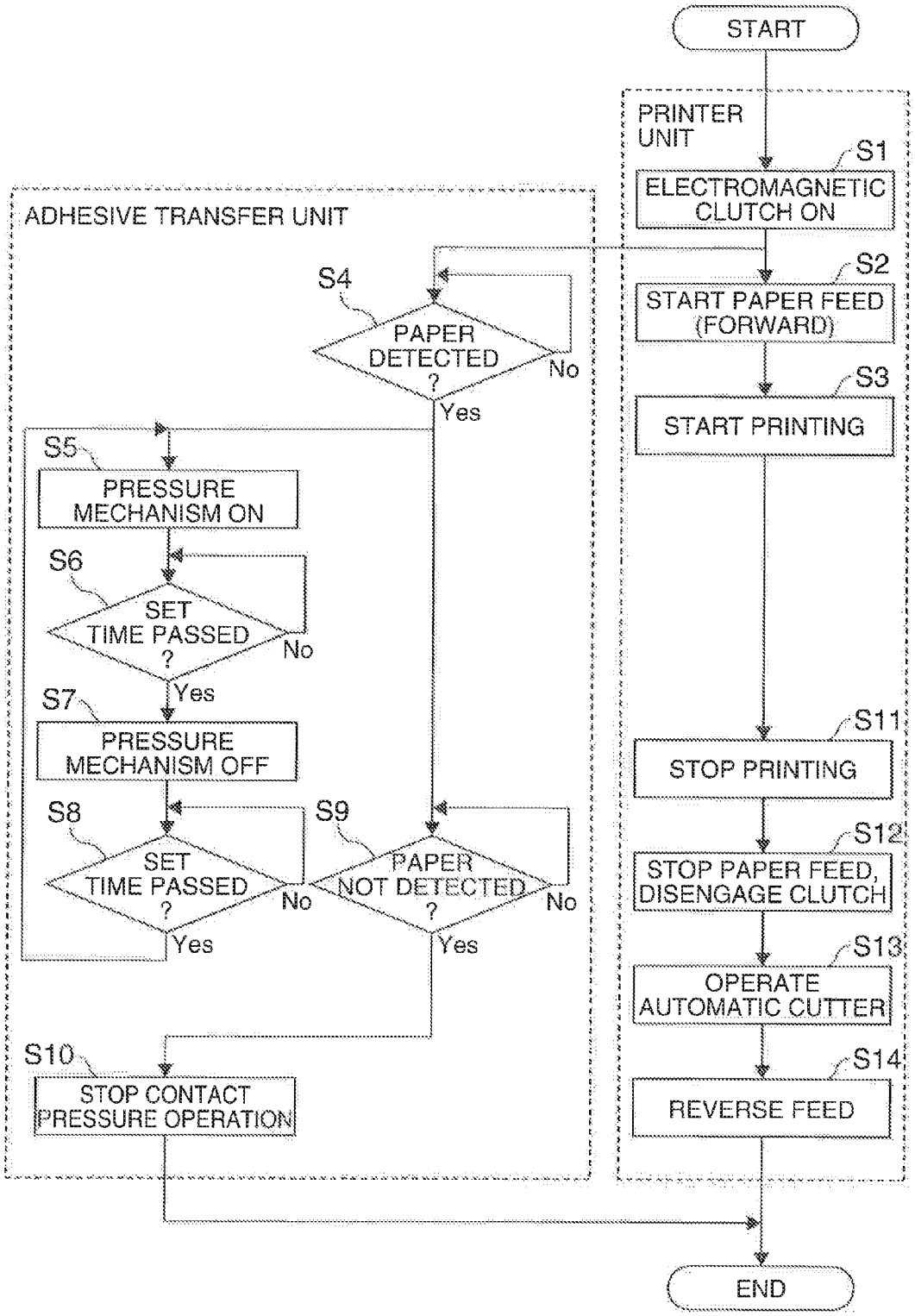
FIG. 4 is a flow chart describing printer control when making adhesive labels.
Figure 5:
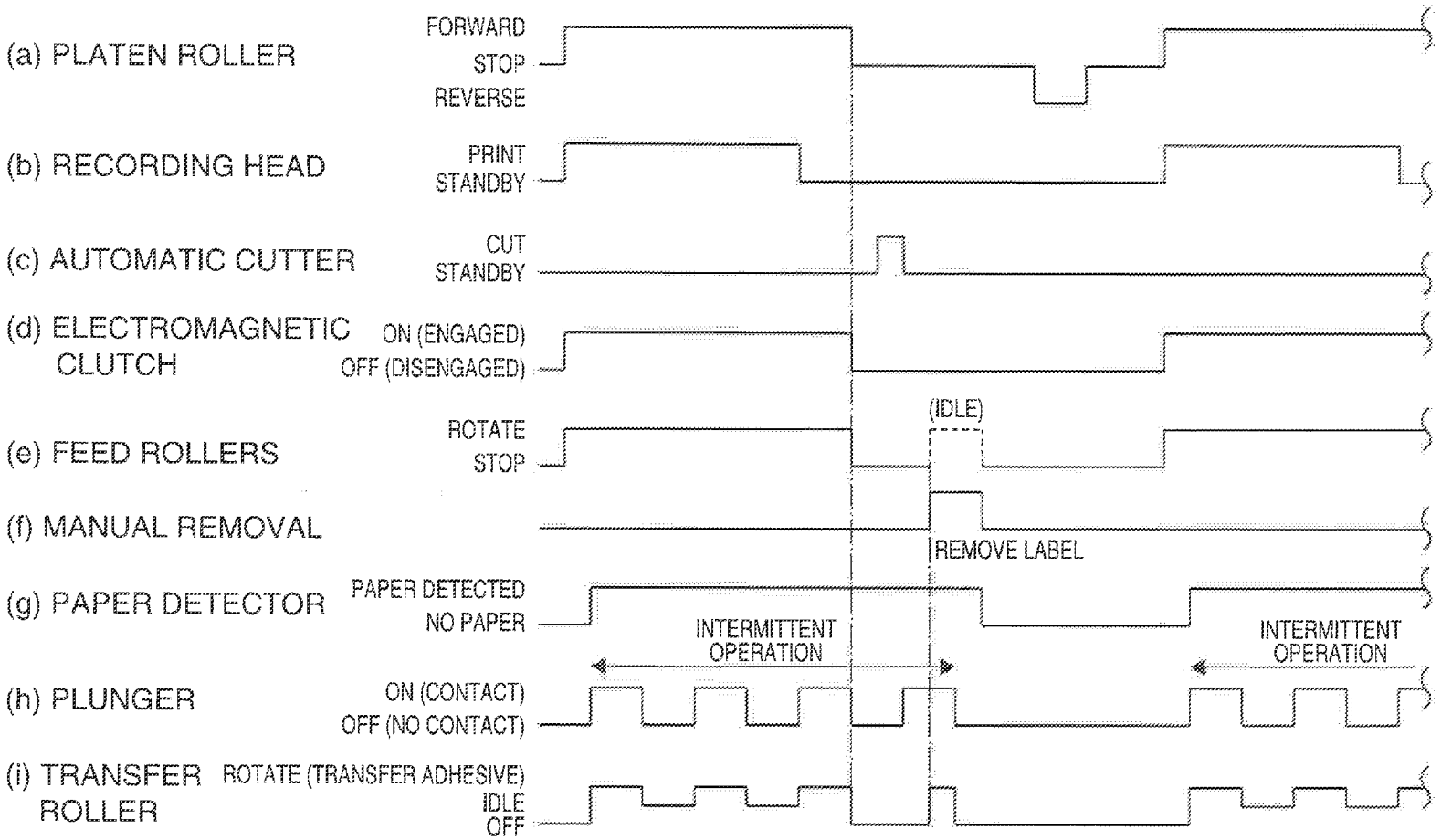
FIG. 5 is a timing chart describing the operation of different parts of the printer when producing adhesive labels.

FIG. 4 is a flow chart describing printer control when producing adhesive labels. FIG. 5 is a timing chart showing the operation of particular printer parts during adhesive label production, FIG. 5 (*a*) showing the operation of the platen roller, FIG. 5 (*b*) the recording head, FIG. 5 (*c*) the automatic paper cutter, FIG. 5 (*d*) the electromagnetic clutch, FIG. 5 (*e*) the feed rollers, FIG. 5 (*g*) the paper detector, FIG. 5 (*h*) the plunger of the pressure mechanism, and FIG. 5 (*i*) the transfer roller. FIG. 5 (*f*) shows the timing when the user manually removes an adhesive label.

The control unit 30 of the printer 1 starts the operation shown in the flow chart in FIG. 4 when print data is received. More specifically, the electromagnetic clutch 23 is engaged in the printer unit 1A in step S1. Driving the paper feed motor 20 starts in step S2, causing the platen roller 6 to start rotating forward and begin conveying the recording paper P to the downstream side. The feed rollers 11A and 11B also start turning at this time.

When the print area on the recording paper Preaches the printing position A, control goes to step S3. At step S3 the control unit 30 starts driving the recording head 5, and begins printing on the recording paper P in conjunction with conveying the recording paper P.

In step S2 the control unit 30 starts the recording paper P transportation operation and also starts operation of the adhesive transfer unit 1B. More specifically, in step S4 the control unit 30 monitors the detection signal from the paper detector 10 at a regular interval. If the detection signal from the paper detector 10 indicates paper was detected (step S4 returns Yes), the control unit 30 starts the contact operation of the pressure mechanism 17 (steps S5 to S8) parallel to the paper feed and printing operations started in steps S2 and S3. The timing at which this contact operation starts can be suitably adjusted according to the distance from the paper detector 10 to the transfer position C.

In steps S5 to S8 the control unit 30 switches the pressure mechanism 17 between the contact state and the non-contact state at a regular interval. Driving the plunger 19 starts in step S5, setting the pressure mechanism 17 to the contact state. While holding this contact state, the control unit 30 watches a timer to determine if a set time has passed in step S6. When this time has passed (step S6 returns Yes), driving the plunger 19 stops and the pressure mechanism 17 is set to the non-contact state in step S7. Control then goes to step S8, and the control unit 30 watches a timer to determine if a set time has passed in step S8. When this time has passed (step S8 returns Yes), control returns to step S5.

After starting step S5, the control unit 30 stops monitoring if the paper detector 10 outputs a paper-detected signal (step S4) and starts looking for a no-paper signal (step S9). The process of steps S5 to S8 continues while monitoring the paper detector 10 in step S9. The control unit 30 repeats steps S5 to S8 until the detection signal from the paper detector 10 indicates a no-paper state. When the detection signal from the paper detector 10 indicates a no-paper state (step S9 returns Yes), control goes to step S10. The intermittent contact operation of the pressure mechanism 17 is stopped in step S10, and the pressure mechanism 17 is set to the non-contact state.

The control unit 30 continues the printing and paper feed operations of the printer unit 1A while executing the paper detection process in the adhesive transfer unit 1B and applying pressure by means of the pressure mechanism 17. Once printing the content instructed by the print data is completed, the control unit 30 goes to step S11 and stops driving the recording head 5. Then in step S12 the control unit 30 conveys the recording paper P until the cutting position of the recording paper P reaches the cutting position B of the automatic cutter 4, and then stops conveying the recording paper P. The platen roller 6 and feed rollers 11A and 11B therefore stop turning. The electromagnetic clutch 23 is also disengaged.

The control unit 30 then goes to step S13 and executes the recording paper P cutting process. Then in step S14 the control unit 30 enters a printing standby state or reverses the recording paper P for reindexing to start the next print job, for example. The process on the printer unit 1A side thus ends. Because this reversing operation occurs when the electromagnetic clutch 23 is disengaged, the recording paper P to which the adhesive was transferred is not reversed. As a result, adhesive does not adhere to parts upstream from the transfer position C, and paper jams caused by adhesive can be prevented.

Note that the control unit 30 could execute the automatic cutter operation and reversing operation of steps S13 and S14 only when commands for executing those operations have been received. In this case executing the reversing operation could be omitted when the automatic cutter operation is not executed. This prevents reversing the uncut portion of the recording paper P to which adhesive has been transferred. Paper jams can thus be prevented.

The printed recording paper P continues being conveyed by rotation of the platen roller 6 and feed rollers 11A and 11B until the paper feed motor 20 stops in step S12. At this time adhesive is transferred by the contact operation of steps S5 to S8 to the part of the recording paper P passing the position. Because this contact operation executes intermittently in this embodiment of the invention, a period when adhesive is transferred and a period when adhesive is not transferred alternately repeat. As a result, adhesive is transferred to the reverse side of the recording paper P at specific intervals.

In this embodiment of the invention the electromagnetic clutch 23 is disengaged after the automatic cutting operation of the automatic cutter 4. As a result, the cut-off portion of the recording paper P is held at this position until it is manually removed by the user. The portion of the recording paper P with adhesive applied thereto is thus prevented from falling out of the printer 1 before it is removed by the user.

The user can remove the cut recording paper at any time after the paper is cut by the automatic cutter 4 as shown in FIG. 5 (*f*). The intermittent contact operation of the pressure mechanism 17 continues in this embodiment of the invention until the detection signal from the paper detector 10 indicates there a no-paper state. More specifically, because the recording paper P remains between the cutting position B and transfer position C until the paper is manually removed by the user after being cut by the automatic cutter 4, the paper-detected state continues and the intermittent contact operation continues.

Therefore, when the user manually removes the recording paper at this time, the trailing end of the recording paper on the upstream side of the transfer position C passes the transfer position C, and adhesive is intermittently transferred to this part of the paper at the specified interval. The length of recording paper removed by the user can therefore be used as an adhesive label that has adhesive applied intermittently to the full length thereof from the leading end to the trailing end. Because the electromagnetic clutch 23 is disengaged while the recording paper is pulled out manually, the feed rollers 11A and 11B rotate freely and therefore do not inhibit removing the recording paper.

When the trailing end of the recording paper passes the detection position of the paper detector 10, the pressure mechanism 17 switches to the non-contact position as described in step S10. Transfer of adhesive therefore stops just before the trailing end of the printed paper passes the transfer position C.

Operation of the adhesive transfer unit 1B thus ends.

As described above, this embodiment of the invention can produce adhesive labels using inexpensive plain paper instead of using expensive recording media such as label paper that is precoated with adhesive. The cost of producing adhesive labels can therefore be reduced compared with the related art. Printing and cutting the paper can also continue with the transfer mechanism 9 set to the non-contact position. As a result, the printer can also be used to issue receipts, for example. A printer according to this embodiment of the invention is therefore extremely convenient because it can be used to print both adhesive labels and receipts using the same recording paper P (plain paper).

With the configuration according to this embodiment of the invention whereby adhesive is transferred to the recording paper P after passing the cutting position B of the automatic cutter 4, adhesive or release agent will not transfer to or build up on the recording head 5, the automatic cutter 4, or parts of the transportation path upstream from the transfer position C. Applying an anti-stickiness treatment to these parts in order to prevent paper jams and printing problems caused by the adhesive or release agent is therefore not necessary. A mechanism for removing adhesive, and regular maintenance to remove adhesive, are therefore also not necessary. Moreover, a bulky heating mechanism and power supply for activating by heating an adhesive coating on the recording paper P are also not necessary. The construction of the printer 1 can thus be simplified, device cost can be reduced, and maintenance needs are reduced.

Other Embodiments (1) The transfer roller 12 is disposed to rotate in unison with the axle 13 in the foregoing embodiment, but the transfer roller 12 could rotate freely on the axle 13. In this case, the adhesive tape T stuck to the recording paper P by the contact pressure is pulled downstream with the recording paper P when contact pressure is applied and the recording paper P is conveyed, and the transfer roller 12 around which the adhesive tape T is wound also turns. Adhesive can therefore be transferred in the same way as when the transfer roller 12 rotates in unison with the axle 13. Furthermore, when the transfer roller 12 rotates freely on the axle 13, the transfer roller 12 does not turn and stops moving when in the non-contact position. When adhesive is not transferred, the adhesive tape T is therefore not taken up. Adhesive tape T waste can therefore be reduced.

(2) The pressure mechanism 17 switches between the contact position and the non-contact position at a regular interval in the foregoing embodiment, but the timing of this change in position can be desirably adjusted according to the transfer position and the transfer range of adhesive to the recording paper. The adhesive transfer position and transfer range can thus be appropriately changed. For example, by increasing the contact period and decreasing the non-contact period, the area to which adhesive is transferred can be increased. Adhesive can also be transferred only to selected areas, such as only to the leading end and trailing end of the cut recording paper, or only to the middle of the recording paper. Furthermore, pressure is applied intermittently after the recording paper P is positioned and stopped at the cutting position B in this embodiment of the invention, but contact pressure could be maintained after the paper is stopped and the non-contact position assumed after a no-paper state is detected. This prevents the operation applying contact pressure from repeating intermittently when the recording paper is not moving.

(3) A print mechanism 3 having a thermal head and a platen roller is used in the foregoing embodiment, but an inkjet print mechanism can be used instead. In this case the printer unit 1A preferably has a paper feed roller separate from the print mechanism.

(4) The adhesive transfer unit 1B in the embodiment described above uses adhesive carried on a release tape to transfer adhesive to the recording medium, but an adhesive application mechanism that applies adhesive to the recording paper P using a non-transfer method can be used instead. For example, adhesive application mechanisms such as an adhesive coating mechanism using a roll coater, or a stamping mechanism that presses the recording paper P against a stamping surface that exudes adhesive, may be used.

(5) The adhesive transfer unit 1B in the foregoing embodiment may be rendered as an adhesive transfer module that is removably attachable to the printer unit 1A. An adhesive application mechanism that applies adhesive to the recording paper P using a non-transfer method can also be rendered as an adhesive application unit that can be removably attached to the printer unit 1A. Such a unit is disposed at a position downstream from the cutting position B of the automatic cutter 4. This enables converting a receipt printer to a printer for producing adhesive labels as needed, and reversing the conversion. Using a single device for multiple purposes enables reducing device cost and improving user convenience.

The invention being thus described, it will be obvious that it may be varied in many ways. Such variations are not to be regarded as a departure from the spirit and scope of the invention, and all such modifications as would be obvious to one skilled in the art are intended to be included within the scope of the following claims.

What is claimed is:

1. A printer comprising:

a transportation mechanism configured to convey a recording medium web through a transportation path passed a printing position;

a recording head configured to print on the front side of the recording medium at the printing position;

an automatic cutter configured to cut the recording medium at a cutting position downstream from the printing position on the transportation path;

a recording medium detection sensor disposed downstream from the automatic cutter on the transportation path;

an adhesive application mechanism disposed downstream from the recording medium detection sensor and configured to apply adhesive to the reverse side of the recording medium passing downstream from the cutting position on the transportation path, and which includes:

a transfer roller configured to transfer adhesive that is coated on a release film to the reverse side of the recording medium passing a transfer position that is located downstream from the cutting position on the transportation path; and a pressure mechanism configured to apply a pressure to the transfer roller, and to produce a contact state in which the recording medium is pressed against the adhesive coating surface, or a non-contact state in which the recording medium is not pressed against the adhesive coating surface, by moving a pressure member opposing the roller surface of the transfer roller to and away from the roller surface; and a control unit configured to switch the pressure mechanism between the contact state and the non-contact state based on output from the detection sensor, wherein the control unit switches the pressure mechanism to the contact state when the recording medium detection sensor indicates the recording medium is detected, and switches the pressure mechanism to the non-contact state after a predetermined elapsed time.

2. The printer described in claim 1, wherein the transfer roller includes a supply unit configured to supply the release film to the transfer roller, and a take-up unit configured to rewind the release film after passing the transfer roller.

3. The printer described in claim 1, wherein the control unit alternately switches the pressure mechanism between the contact state and the non-contact state at a specified interval when the recording medium detection sensor indicates the recording medium is detected.

4. The printer described in claim 1, further comprising:

a first transportation roller configured to convey the recording medium at a first transportation position upstream from the cutting position on the transportation path;

a second transportation roller configured to convey the recording medium at the transfer position; and a transmission mechanism configured to cause the second transportation roller to rotate in conjunction with rotation of the first transportation roller.

5. The printer described in claim 4, wherein the second transportation roller is disposed coaxially with the transfer roller, and the transfer roller and second transportation roller rotate in unison.

6. The printer described in claim 4, further comprising:

a clutch configured to switch between an engaged position causing the second transportation roller to rotate in conjunction with the first transportation roller, and a disengaged position that does not cause the second transportation roller to rotate in conjunction with the first transportation roller.

7. The printer described in claim 4, wherein the second transportation roller is attached to both ends of a rotating shaft of the transfer roller with the transfer roller therebetween, and is disposed within the width of the recording medium at the transfer position.

8. The printer described in claim 1, wherein the adhesive application mechanism is rendered as an adhesive application unit that is removably attached to the printer downstream from the cutting position.

9. The printer of claim 2, wherein the transfer roller includes the transfer roller that is attached to an axle extending transversely to a direction of extension of the release film.

10. The printer of claim 9, further including:

feed rollers disposed on opposite sides of the axle, wherein the transfer roller is located between the feed rollers.

11. The printer of claim 9, further including:

a supply unit, wherein the take-up unit is configured to rotate freely on a rotational axis parallel to the transfer roller.

12. The printer of claim 9, further including:

a reciprocating plunger configured to push a pressure platen to a roller surface of the transfer roller and to retract the pressure platen from the roller surface.

* * * * *